US010272928B2

(12) United States Patent
Rutherford

(10) Patent No.: US 10,272,928 B2
(45) Date of Patent: Apr. 30, 2019

(54) ADJUSTABLE WEIGHT TRANSFER SYSTEM FOR BOGIE

(71) Applicant: Caterpillar Inc., Peoria, IL (US)

(72) Inventor: Stephen P. Rutherford, Edwards, IL (US)

(73) Assignee: Caterpillar Inc., Deerfield, IL (US)

( * ) Notice: Subject to any disclaimer, the term of this patent is extended or adjusted under 35 U.S.C. 154(b) by 246 days.

(21) Appl. No.: 15/386,274

(22) Filed: Dec. 21, 2016

(65) Prior Publication Data

US 2018/0170408 A1 Jun. 21, 2018

(51) Int. Cl.

| | |
|---|---|
| ***B61F 3/08*** | (2006.01) |
| ***B61F 5/04*** | (2006.01) |
| ***B61F 5/38*** | (2006.01) |
| ***B61F 5/40*** | (2006.01) |

(52) U.S. Cl.

CPC ..... *B61F 5/40* (2013.01); *B61F 3/08* (2013.01); *B61F 5/04* (2013.01); *B61F 5/386* (2013.01)

(58) Field of Classification Search

CPC ..... B61F 5/04; B61F 5/14; B61F 5/40; B61F 3/08

See application file for complete search history.

(56) References Cited

U.S. PATENT DOCUMENTS 1,414,916 A * 5/1922 Anderson ..... B61F 5/40 105/179
2,389,521 A * 11/1945 Leppla ..... B61F 5/12 105/190.2
2,555,011 A * 5/1951 Schrage ..... B61F 3/16 105/198.7
4,480,553 A * 11/1984 Scheffel ..... B61F 5/148 105/167
4,760,799 A * 8/1988 Jackson ..... B61F 5/24 105/182.1
5,123,358 A * 6/1992 Kemppainen ..... B61F 5/38 105/167
5,346,233 A * 9/1994 Moser ..... B62D 53/068 180/24.01
5,658,000 A * 8/1997 Boudreaux ..... B62D 21/14 180/209
6,196,134 B1 * 3/2001 Stecker ..... B61F 5/04 105/199.1

(Continued)

FOREIGN PATENT DOCUMENTS

| | | |
|---|---|---|
| DE | 202004006840 U1 | 7/2004 |
| DE | 202005017281 U1 | 12/2005 |
| FR | 2809356 A1 | 11/2001 |

*Primary Examiner* — Jason C Smith

(74) *Attorney, Agent, or Firm* — Leydig, Voit & Mayer, Ltd.

(57) ABSTRACT

A bogie for a train vehicle includes two side frames, each side frame including two axle openings, each axle opening disposed on a corresponding end of the respective side frame, each side frame further forming a central slot disposed between the two axle openings; two wheelsets, each wheelset including an axle passing through two opposing axle openings between the two side frames; and a central beam having two ends, each end being slidably disposed within a corresponding central slot such that the central beam is disposed generally parallel to the axles of the two wheelsets and is slidable towards or away either of the two wheelsets.

16 Claims, 7 Drawing Sheets

(56) References Cited

U.S. PATENT DOCUMENTS

| | | | | |
|---|---|---|---|---|
| 7,410,183 | B2 * | 8/2008 | Stowell | B62D 53/068 280/149.2 |
| 8,122,835 | B2 * | 2/2012 | Korner | B61C 9/48 105/133 |
| 2004/0255563 | A1 * | 12/2004 | Schafer | A01D 41/00 56/1 |
| 2005/0022689 | A1 * | 2/2005 | Forbes | B61F 5/122 105/198.2 |
| 2007/0017715 | A1 * | 1/2007 | McCann | B62D 53/068 180/24.02 |
| 2008/0269986 | A1 * | 10/2008 | Regnell | B60G 17/019 701/37 |
| 2015/0344046 | A1 * | 12/2015 | Nishimura | B61F 5/52 105/199.1 |
| 2015/0353105 | A1 * | 12/2015 | Nishimura | B61F 5/52 105/199.1 |
| 2018/0170408 | A1 * | 6/2018 | Rutherford | B61F 5/40 |

* cited by examiner

ADJUSTABLE WEIGHT TRANSFER SYSTEM FOR BOGIE

TECHNICAL FIELD

This patent disclosure relates generally to rail equipment and, more particularly, to rail bogies or trucks used on rail carriages.

BACKGROUND

A rail bogie, which is also known as a railroad truck, wheel truck, or truck, is a rolling support structure that is pivotally connected at one end of a rail vehicle. The bogie includes suspension systems and axles having wheels that allow the rail carriage or locomotive to travel over a railway. In a typical configuration, a rail carriage includes two, pivotally connected bogies on its underside. Bogies are typically placed close to the ends of the carriages and include structures for releasably being connected to bogies of adjacent carriages or locomotives.

A typical bogie functions to support of the rail vehicle body, provide ride stability to the rail vehicle during travel on straight or curved railway sections, and improve ride quality for cargo and passengers by absorbing vibration and managing the effects of centrifugal forces, especially when the rail vehicle travels over curves at high speeds.

Most bogies have two axles, and each axle has two wheels. Other configurations, e.g. bogies providing traction to locomotives or bogies used for particularly high load applications, may include more than two axles. Usually, the floor of the rail vehicle is situated at a level generally above the bogie, at the top of a frame or platform. The frame may include an enclosure for cargo or passengers, and may be specially tailored to suit the particular application for the rail vehicle. The main structures of a bogie are the frame, suspension, one or more wheelsets, each wheelset including an axle with bearings and a wheel at each end, and an axle box, which absorbs shocks between the axle bearings and the bogie frame. Typical bogie applications may further include brake equipment such as shoes that are pressed against the tread of the wheel, or disc brakes that are pressed against pads attached to the axles. In powered applications, the bogies may further include motive equipment such as a transmission, electrically powered traction motors, torque converters, and the like.

A typical connection between the bogie and the rail vehicle is arranged to allow for rotational movement around a vertical axis pivot, which is also known as a bolster, with side bearers preventing excessive movement. In certain more modern applications, bolsters can be omitted. The relative rotation between the bogie and the frame of the rail vehicle allows the rail and you the vehicle to traverse curves in the tracks.

While bogies have been used for decades in rail travel, the pivotal connection at the bolster, or its modern variations, may not be best suited for the most efficient train operation possible. For example, uneven rail vehicle loading may cause increased rolling resistance, decreased traction and increased wear between the bogie and the tracks.

SUMMARY

The disclosure describes, in one aspect, a bogie for a train vehicle. The bogie includes two side frames, each side frame including two axle openings, each axle opening disposed on a corresponding end of the respective side frame, each side frame further forming a central slot disposed between the two axle openings; two wheelsets, each wheelset including an axle passing through two opposing axle openings between the two side frames; and a central beam having two ends, each end being slidably disposed within a corresponding central slot such that the central beam is disposed generally parallel to the axles of the two wheelsets and is slidable towards or away either of the two wheelsets.

In another aspect, the disclosure describes a rail vehicle. The rail vehicle includes a platform; two bogies pivotally connected, one each, at either of two ends of the platform. Each bogie includes two side frames, each side frame including two axle openings, each axle opening disposed on a corresponding end of the respective side frame, each side frame further forming a central slot disposed between the two axle openings; two wheelsets, each wheelset including an axle passing through two opposing axle openings between the two side frames; and a central beam having two ends, each end being slidably disposed within a corresponding central slot such that the central beam is disposed generally parallel to the axles of the two wheelsets and is slidable towards or away either of the two wheelsets.

In yet another aspect, the disclosure describes a method for operating a rail vehicle. The method includes determining a loading condition of a bogie of the rail vehicle in terms of a load applied into a socket of the bogie and reaction forces present at each of at least two wheelsets of the bogie; determining whether a reaction force at one of the at least two wheelsets is imbalanced relative to a reaction force present at the second of the at least two wheelsets; and adjusting a geometrical relation between the socket of the bogie and each of the at least two wheelsets of the bogie when an imbalance is detected and until the reaction forces are equalized.

DETAILED DESCRIPTION

Figure 1:
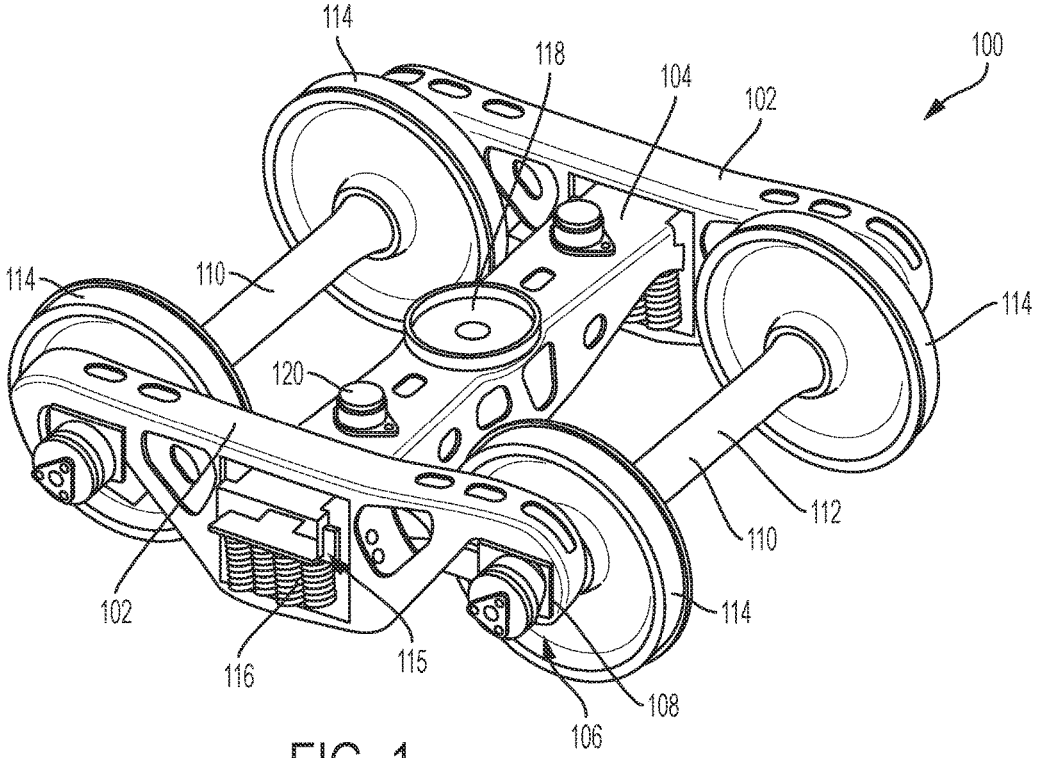
FIG. 1 PRIOR ART
FIG. 1 is an outline view of a current rail bogie to illustrate certain structures thereof.

FIG. 1 is an outline view of a known design for rail bogie 100, to illustrate the various base structures thereof. It should be appreciated that, while the rail bogie 100 shown in the illustration is a non-powered bogie used for drawn rail vehicles, the systems and methods that are described hereinafter are applicable to both powered bogies such as those used by locomotives, and non-powered bogies like the one shown. The rail bogie 100 includes two side frames 102 that are connected to one another by a central beam 104 in an H configuration. Each frame 102 forms two axle openings 106, one on either end, that support bearings 108. A wheelset 110 that includes an axle 112 and two rail wheels 114 is rotatably supported relative to the frames 102 by the bearing 108. In the case of a powered bogie, motors, torque converters, gears and other motive equipment may also be used in the known fashion.

The central beam 104 is slidably supported in the vertical direction in central openings 115 of the side frames 102 and, in the illustrated embodiment, suspended therein by springs 116. The springs 116 and the possibility for relative, vertical motion between the central beam 104 and the two side frames 102 provides suspension for the bogie during operation. In alternative embodiments, independent suspension structures may be provided between each wheelset and the frames, in addition to or instead of the spring 116 disposed between the central beam 104 and the frames 103. The central beam 104 includes a socket joint 118 that accepts a pad onto which the frame of a rail car is connected at what is usually referred to as a bolster joint. A typical bolster joint includes a ball and socket type of interface that also includes a pin or rod that pivotally connects the bogie with a rail car or rail vehicle. Two lateral supports 120 are disposed on the central beam 104 on either side of the socket 118. The lateral supports 120 support the frame of the railcar disposed on the rail bogie 100 when lateral displacement of the railcar occurs, for example, during loading, when turning, or when the rail car is traversing inclined tracks, because of the relative motion of the railcar in the socket 118 at the bolster joint.

Figure 2:
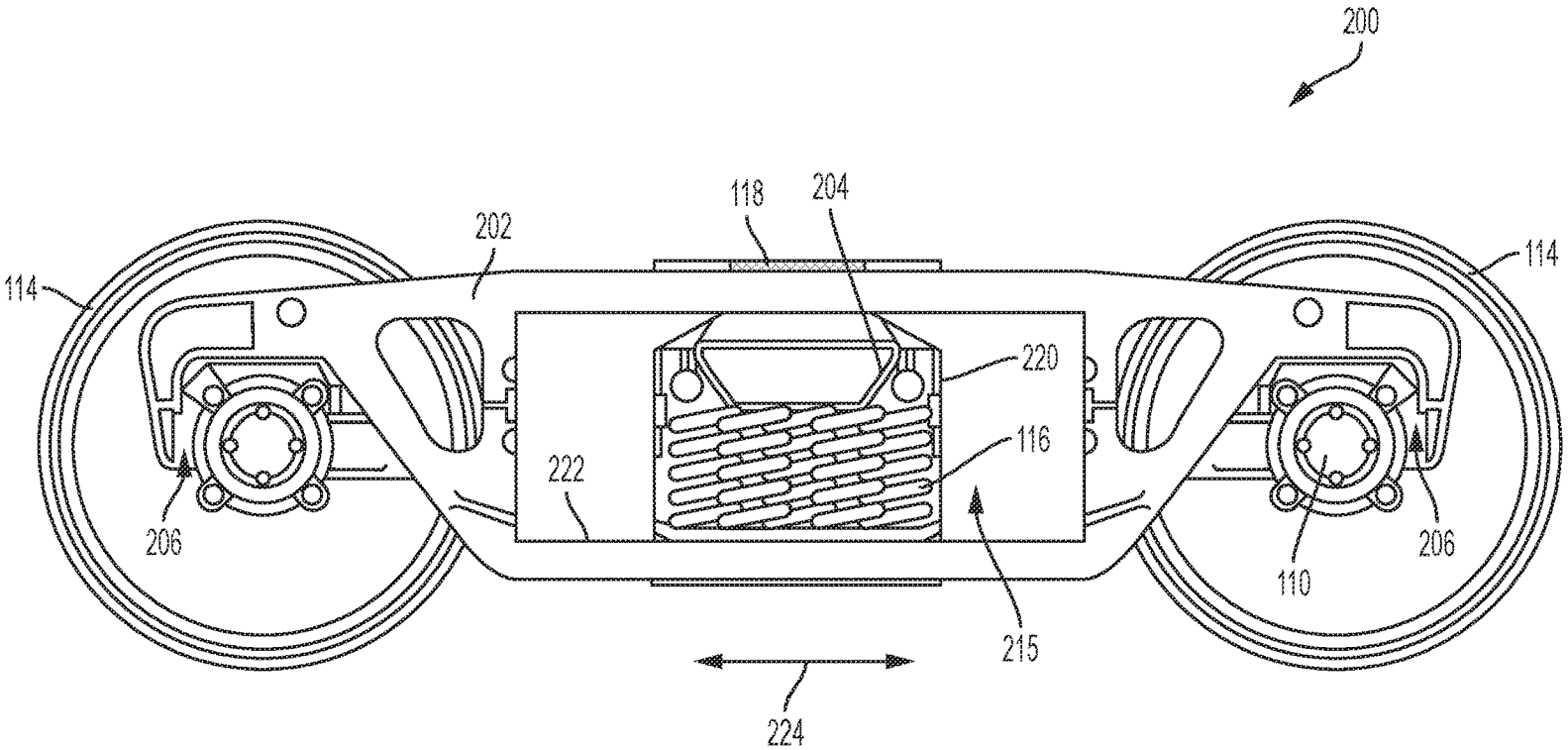
FIG. 2 is an outline view from a side perspective of a rail bogie in accordance with the disclosure.

An improved rail bogie 200 and accordance with the disclosure is shown in FIG. 2. Regarding the improved rail bogie 200, in the description that follows, structures or features that are the same or similar to corresponding structures and features of the rail bogie 100 may be denoted by the same reference numbers previously used for simplicity. Moreover, the rail bogie 200 may be embodied in a powered configuration, which may also include various motive components and systems such as motors, transmissions, torque converters and the like. The exemplary embodiment for the bogie 200 being of the non-powered variety should not, therefore, be understood as limiting or definitive of the scope of the disclosure.

Accordingly, the rail bogie 200 includes two side frames 202 (only one visible), which form two axle openings 206. A corresponding bearing 108 rotatably supports a respective wheelset 110. Each side frame 202 includes an elongated central opening 215 that slidably accepts therein an end-block 220. The rail bogie 200 includes two end-blocks 220 that are disposed, one each, on either side of the central beam 204.

The inner frame 222 of each central opening 215 of each side frame 202 slidably engages the end block 220 and constrains the same to move only in one, axial direction 224 that is perpendicular to the axles 112 of the wheelsets 110. In this way, the geometrical relation between the central beam and each of the wheelsets can be adjusted. Specifically, the central beam 204 is arranged to move relative to the side frames 202 by approaching either of the two wheelsets 110 while also remaining parallel there with since it is constrained to move only in the axial direction 224. The rail bogie 200 otherwise includes the same or similar structures to the rail bogie 100 such as the socket 118, the lateral supports 120, the springs 116 and other structures commonly found in rail bogies that include breaks and secondary suspension systems, which are not shown herein for simplicity. The rail bogie 200 also includes the actuators that move and retain the end block 220 at a desired position relative to each side frame 202, as will be shown and discussed in the embodiments that follow. The rail bogie 200 may also include motive components such as motors and the like, which are not shown for simplicity.

Figure 3:
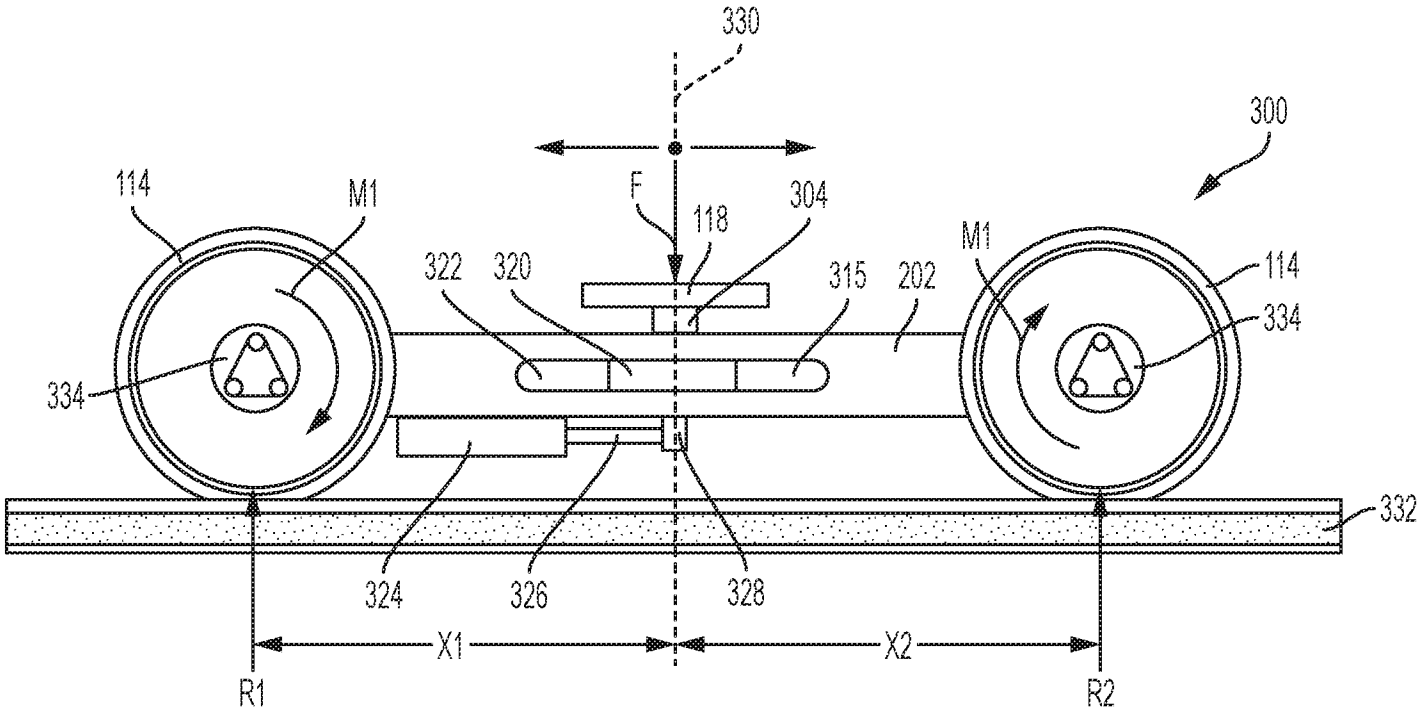
FIGS. 3 and 4 are schematic representations of two alternative embodiments for rail bogies in accordance with the disclosure.
Figure 4:
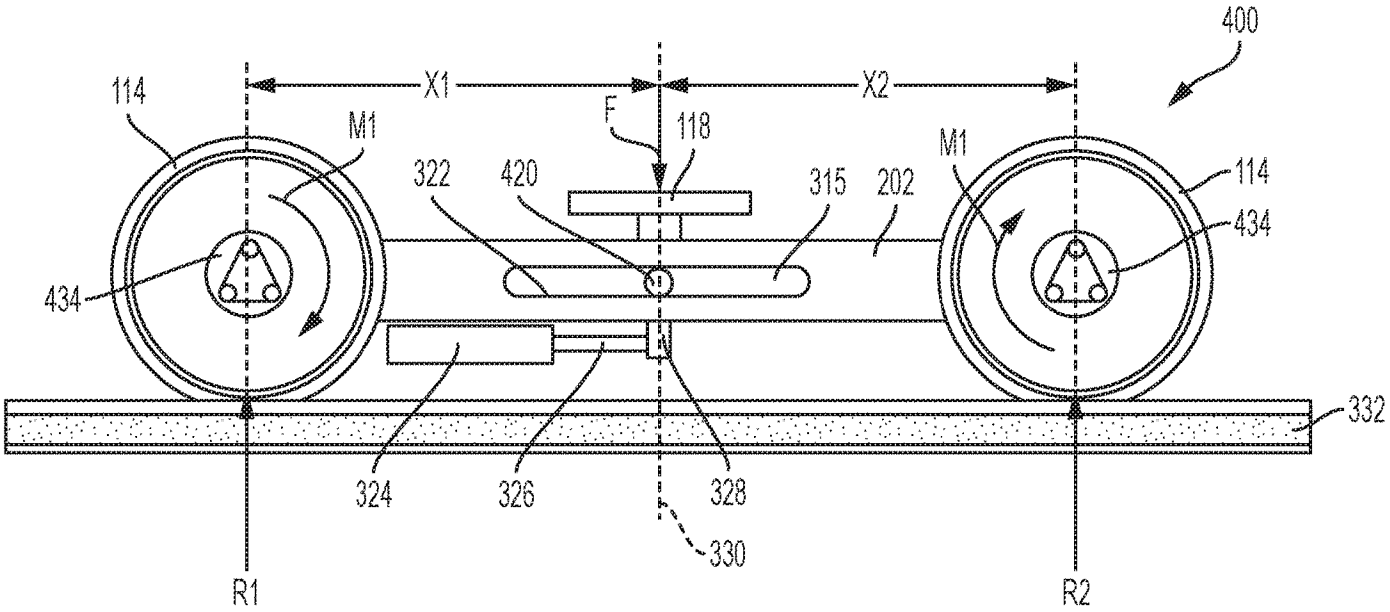

Two alternative embodiments for rail bogies in accordance with the disclosure is shown in FIGS. 3 and 4. As before, features and elements that are the same or similar to corresponding features and elements previously described are denoted by the same reference numerals as previously used for simplicity. In the embodiment shown in FIG. 3, a rail bogie 300 includes two side frames 202 (one visible) and two wheelsets having wheels 114 (two visible). In the illustrated embodiment, the side frame 202 includes an elongate slot 315 having a frame 322 that slidably supports and restrains a sliding block 320 to move axially along a length of the slot 315. As in the previous embodiment, the sliding block 320 is connected to a center beam 304 that includes the socket 118. For moving the block 320 and, thus, also the socket 118, relative to the wheels 114, the rail bogie 300 also includes an actuator 324. In the illustrated embodiment, the actuator 324 is connected directly onto the side frame 102 and is embodied as a pneumatic cylinder having a movable rod 326 that is connected to a coupling 328. The pneumatic actuator 324 may be fluidly connected to a high-pressure air from the braking system of the train onto which the rail vehicle is part of. Alternatively, the actuator 324 may be electrically powered from the trains electrical system or may also be a hydraulic actuator that is powered by a source of hydraulic fluid provided to the actuator on the train vehicle itself. The coupling 328 is integral with the block 320 in the center beam 304 such that a pulling or pushing force from the actuator 324 will operate to move the center beam 304 and also the socket 118 closer to or further from either of the wheelsets on the bogie. The bogie 300 in the illustrated embodiment further includes motors 334 that are connected to the frame 202 and operate to impart a driving force or torque onto the wheels 114. As shown, a motive torque M1 can be applied to drive the wheels 114 and, thus, the train, on the tracks 332.

During operation, a force F due to the weight of the rail vehicle that is supported by the rail bogie 300 and also the weight of any cargo on that rail vehicle is applied on both ends of the rail vehicle onto the corresponding sockets 118. As can be appreciated, the direction of application of the force F is along the vertical axis 330 that passes through the socket 118. To counter the force F, reaction forces R1 and R2, as denoted in FIG. 3, are present between the wheels 114 and the rail 332. The reaction forces R1 and R2 will also determine the friction between the wheels 114 and the tracks 332. Apart from the static force F that may affect the magnitude of the reaction forces R1 and R2, and appreciable effect will also be created while the motive torque M1 is applied. For example, when the torque M1 is applied in the direction shown in FIG. 3, the reaction force R1 will tend to increase, and the reaction force R2 will tend to decrease and counter-moments will be created and accounted for. Depending on the loading condition of the rail vehicle applying the force, F, the direction of application of the force, F, may not always be along the vertical direction 330. For example, when the bogie 300 is travelling on an inclined track, the reaction forces R1 and R2 will change because the direction of application of the force F, and also the motive torque M1, will change. For this reason, the magnitude of the reaction forces R1 and R2, may not be equal as each may change depending on the direction of application of the force F.

In the embodiment shown, because of the ability to move the block 320 relative to the frame 202, the distances and, thus, the moment arms that may determine the magnitude of the reaction forces can also be adjusted. As shown, the reaction force R1 is disposed at a distance X 1 from the axis 330 along which the force F is applied. Similarly, the reaction force R2 is disposed in a moment arm distance X2. In this configuration, the selective activation of the actuator 324 can change a distances capital X1 and X2 to equalize the two reaction forces, even in the presence of the motive torque Ml, regardless of the loading condition of the rail vehicle that imparts the force F onto the socket 118. As can be appreciated, the reaction forces between the wheels 114 in the rail 332 can affect different parameters relating to operation of the bogie such as traction, rolling resistance, and/or reduced wear. In one embodiment, for example, it may be desirable to arrange the bogie such that one of the reaction forces, for example, R1, is larger than the other reaction force R2, to increase the friction between one set of wheels 114 and the track 332 to provide added traction when needed, for example, when ascending an incline, during braking, or in slippery conditions.

In the embodiment shown in FIG. 4, a rail bogie 400 is similar in many respects to the rail bogie 300, but includes a second degree of freedom of rotation about a pin 420, which is moveable in the slot 315 formed in the two side frames 202. The additional degree of freedom of rotation allows an improved counteraction to application of the force F along a non-vertical axis. In its remaining respects, the rail bogie 400 may also include a linkage mechanism to attach the actuator 324 to the frames 202 that will account for the relative rotation of the socket 118 in the central beam 304 respect to the remaining structures of the rail bogie 400.

Accordingly, the rail bogie 400 includes two side frames 202 (one visible) and two wheelsets having wheels 114 (two visible). In the illustrated embodiment, the side frame 202 includes an elongate slot 315 having a frame 322 that slidably supports and restrains a sliding pin 420 to move axially along a length of the slot 315, but also permits relative rotation along an axis extending through the sliding pin 420 of the socket 118 with respect to the side frames 202. As in the previous embodiment, the sliding pin 420 is connected to a center beam 304 that includes the socket 118. For moving the sliding pin 420 and, thus, also the socket 118, relative to the wheels 114, the rail bogie 400 also includes an actuator 324. In the illustrated embodiment, the actuator 324 is pivotally connected onto the side frame 202 and is embodied as a hydraulic cylinder having a movable rod 326 that is connected to a coupling 328. The coupling 328 is integral with the sliding pin 420 in the center beam 304 such that a pulling or pushing force from the actuator 324 will operate to move the center beam 304 and also the socket 118 closer to or further from either of the wheelsets on the bogie. The bogie 400 further includes motors 434 that are connected to the frame 202 and operate to impart a driving force or torque M1 onto the wheels 114. As shown, the motive torque M1 can be applied to drive the wheels 114 and, thus, the train, on the tracks 332.

During operation, a force F due to the weight of the rail vehicle that is supported by the rail bogie 400 and also the weight of any cargo on that rail vehicle is applied on both ends of the rail vehicle onto the corresponding sockets 118. As can be appreciated, the direction of application of at least a component of the force F is along the vertical axis 330 that passes through the socket 118. To counter the force F, reaction forces R1 and R2, as denoted in FIG. 4, are present between the wheels 114 and the rail 332. The reaction forces R1 and R2 will also determine the friction between the wheels 114 and the tracks 332. Apart from the static force F that may affect the magnitude of the reaction forces R1 and R2, and appreciable effect will also be created while the motive torque M1 is applied. For example, when the torque M1 is applied in the direction shown in FIG. 3, the reaction force R1 will tend to increase, and the reaction force R2 will tend to decrease and counter-moments will be created and accounted for. As compared to the bogie 300, the effect of counter-torque may be increased because of the pin joint at the pin 420. Depending on the loading condition of the rail vehicle applying the force, F, the direction of application of the force, F, may not always be along the vertical direction 330. For example, when the bogie 300 is travelling on an inclined track, the reaction forces R1 and R2 will change because the direction of application of the force F, and also the motive torque M1, will change. For this reason, the magnitude of the reaction forces R1 and R2, may not be equal as each may change depending on the direction of application of the force F.

In the embodiment shown, because of the ability to move the pin 420 relative to the frame 202, the distances and, thus, the moment arms that may determine the magnitude of the reaction forces can also be adjusted. As shown, the reaction force R1 is disposed at a distance X1 from the axis 330 along which the force F is applied. Similarly, the reaction force R2 is disposed in a moment arm distance X2. In this configuration, the selective activation of the actuator 324 can change a distances capital X1 and X2 to equalize the two reaction forces regardless of the loading condition of the rail vehicle that imparts the force F onto the socket 118. As can be appreciated, the reaction forces between the wheels 114 in the rail 332 can affect different parameters relating to operation of the bogie such as traction, rolling resistance, and/or wear. In one embodiment, for example, it may be desirable to arrange the bogie such that one of the reaction forces, for example, R1, is larger than the other reaction force R2, to increase the friction between one set of wheels 114 and the track 332 to provide added traction when needed, for example, when ascending an incline, during braking, or in slippery conditions.

Figure 5:
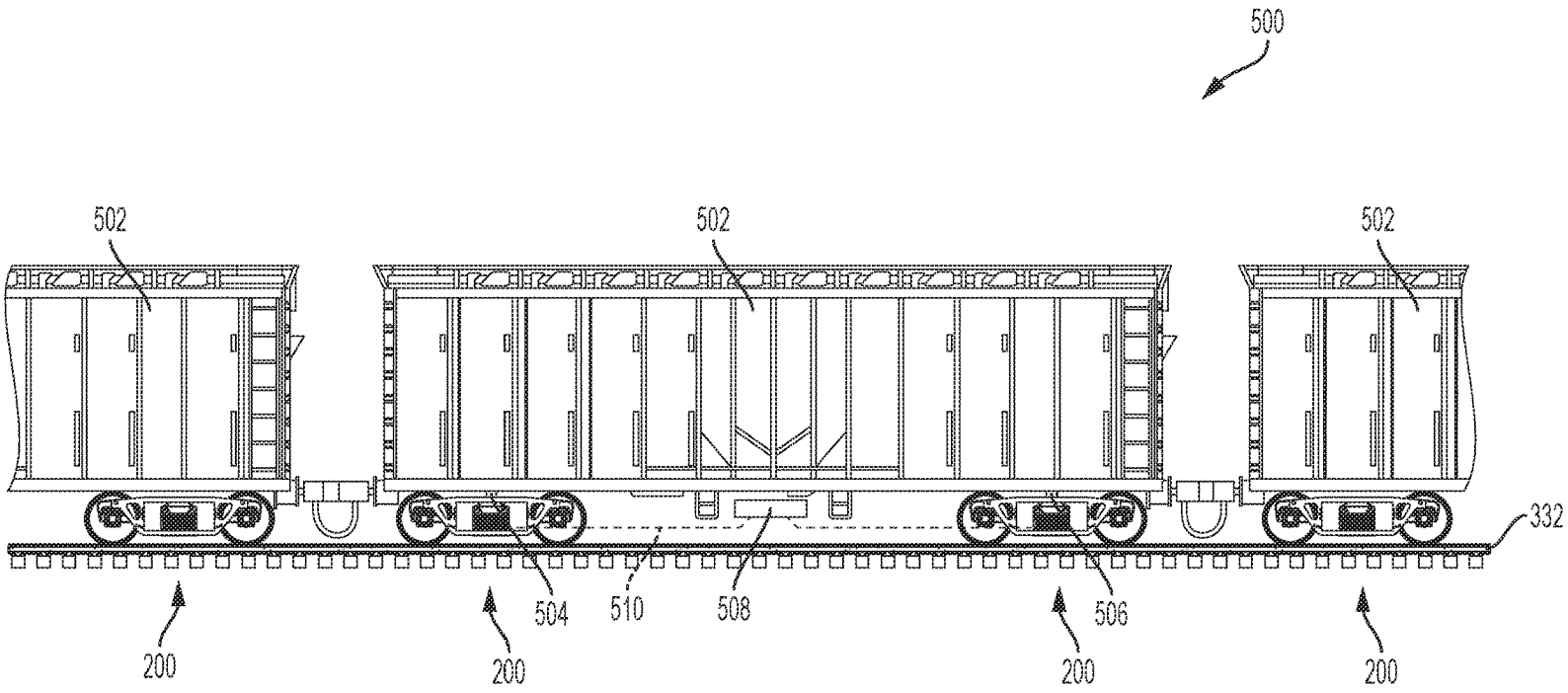
FIG. 5 is a partial view of a train employing rail bogies in accordance with the disclosure.

A schematic view of a train 500, which is partially shown, having rail cars 502 supported on the rails 332 by bogies 200 in accordance with the disclosure is shown in FIG. 5. The rail cars 502 are shown as box cars but it should be appreciated that any type of powered or unpowered rail vehicle can be used. As shown, each rail vehicle 502 is supported by two rail bogies 200, one on either end of the rail vehicle 502. At the bolster connections 504, a sensor 506, which may include an array of sensors, is disposed and configured to monitor at least the magnitude, and also optionally the balance or imbalance and direction of application of a force, e.g., the force F, that represents a weight loading onto the bogie 200 both during static conditions and also in dynamic conditions as the train 500 is travelling on the tracks. During travel, the loading condition on the bogies 200 may change, for example, during travel along straight or curved tracks, up or down inclines, during acceleration or deceleration of the train, and the like.

The sensor 506, which may alternatively be disposed within the bogie wheelsets or along an interface between the wheel sets and the frames to measure the reactionary forces, e.g., R1 and/or R2 (FIG. 3 or 4), provides a signal indicative of the loading condition to a controller 508 via communication lines 510. The controller 508 may be a standalone controller that monitors the forces applied to the bogies in a single train vehicle 502, or it may be a controller that monitors the forces applied to the bogies of a plurality of trained vehicles, including a locomotive. In one embodiment, the controller may be disposed onto the locomotive itself and monitor the forces applied onto the bogies of all train vehicles that are connected to that particular locomotive. The communication lines 510 may be wired connections or may alternatively be wireless connections, especially in the case where multiple train vehicles are monitored by a single controller disposed on any one of the train vehicles or the locomotive that propels the train.

During operation, the signals monitored by the controller 508 are used to determine whether a balance of reaction forces exists between the two wheelsets and each bogie of the train. In the event that an imbalance of reaction forces is detected, both during static and dynamic conditions, the controller commands the appropriate actuator to activate and displace the corresponding socket of the bogie relative to the side frames such that a balance of reaction forces on the particular bogie is restored. Such displacement, can occur while the train a stationary and also while the train is moving in be adjusted continuously during train operation to preserve equality between the reaction forces, ordinary quality, during train operation.

Figure 6:
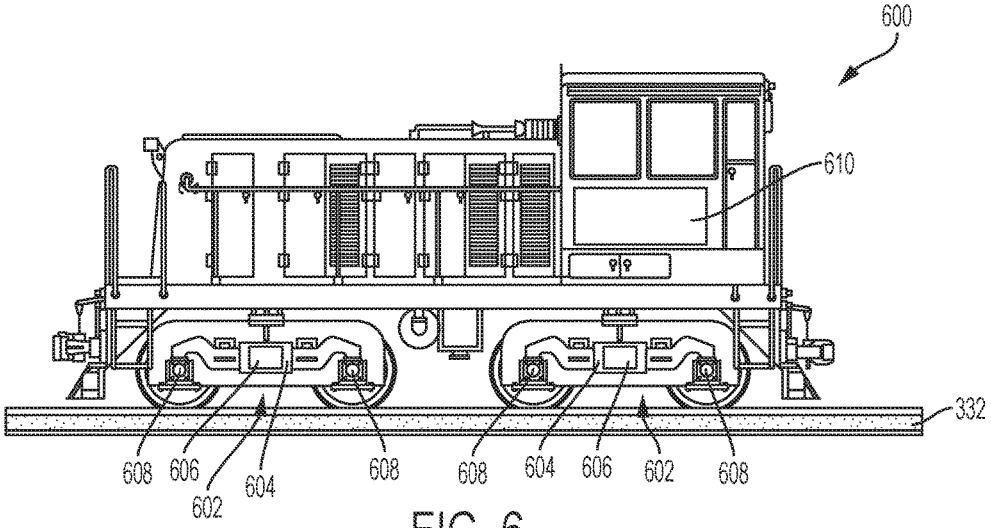
FIG. 6 is an outline view of a locomotive having powered bogies in accordance with the disclosure.
Figure 7:
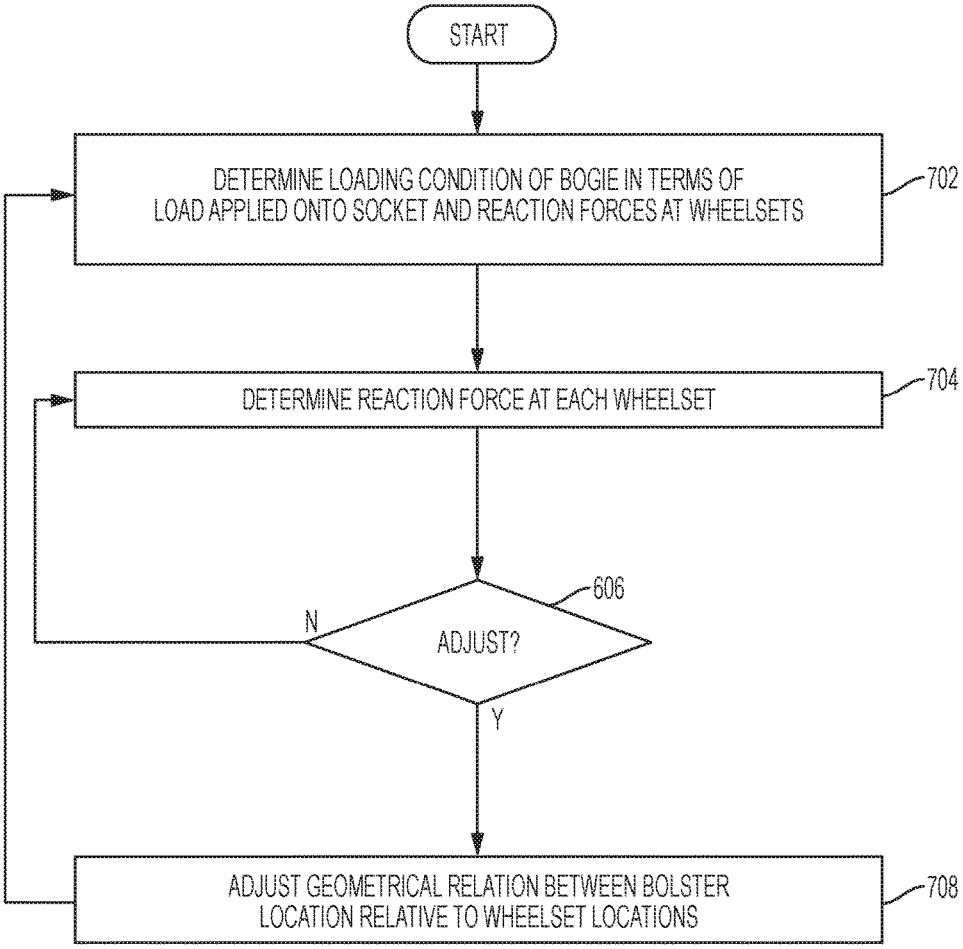
FIG. 7 is a flowchart for a method of operating a rail bogie in accordance with the disclosure.

An outline view of a locomotive 600 having powered bogies 602 is shown in FIG. 6. In this embodiment, each bogie 602 includes a central slot 604 that slidably accepts a block 606 therein, which, as previously described, is selectively moveable to adjust the reaction force between the wheels 114 and the track 332. In this embodiment, the wheels 114 on each wheelset on the bogie 602 may be made or coated with different materials to introduce different friction coefficients between the respective wheels 114 and the tracks 332. For example, the wheels 114 on at least one wheelset of at least one bogie 602 may be coated with rubber to provide additional traction when the locomotive 600 is ascending tracks at a steep incline.

In the illustrated embodiment, speed sensors 608 are associated with each wheelset, although sensors can be used on fewer than all wheelsets. The speed sensors 608 are configured to monitor a rotation rate of each wheelset and provide a respective speed signal indicative of the wheel speed to a controller 610. During operation, the controller 610 may monitor the speed of each wheelset and compare the various wheelset speeds to one another to determine whether one of the wheelsets is spinning or slipping, especially when a motive force is being applied. In the event of a spin, the controller 610 may command the actuators that selectively place the block 606 in the slot 604 of the bogie 602 at which the wheel spin is occurring to move such that a reaction force and, thus, the friction between the wheels of the slipping wheelset and the tracks is increased until the slip has ceased.

INDUSTRIAL APPLICABILITY

A flowchart for a method of operating a train is shown in FIG. 6. The method includes determining a loading condition of the bogie in terms of a load applied onto the socket of the bogie and the reaction forces at the two or more wheelsets of the bogie at 702. Determining the loading condition includes determining the reaction force in each of the wheelsets at 704. When an imbalance condition is desired, depending on the operating state of the bogie, a decision to adjust the reaction forces is carried out at 606, and the controller activates an actuator to adjust the geometrical relation between a location of a bolster of the bogie with respect to the locations of two or more wheelsets of the bogie at 608. For example, when loading is detected at one wheelset that exceeds the loading of a second wheelset, the controller will operate to move the bolster location away from the first wheelset and towards the second wheelset until the loads are equalized when the bogie is operating in a condition where balanced reaction forces are desired, for example, during travel of the train at a constant speed. In other operating conditions, for example, when increased traction is desired or when the train is accelerating or braking, the geometry may be adjusted such that the reaction force and, thus, the friction or traction at one of the wheelsets is increased. This process is repeated continuously during operation.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The invention claimed is:

1. A bogie for a train vehicle, comprising:

two side frames, each side frame including two axle openings, each axle opening disposed on a corresponding end of the respective side frame, each side frame further forming a central slot disposed between the two axle openings;

two wheelsets, each wheelset including an axle passing through two opposing axle openings between the two side frames;

a central beam having two ends, each end being slidably disposed within a corresponding central slot such that the central beam is disposed generally parallel to the axles of the two wheelsets and is slidable towards or away either of the two wheelsets: and an actuator connected between at least one of the two side frames and the central beam, the actuator operating to move the central beam relative to the two wheelsets.

2. The bogie of claim 1, wherein each central slot includes a frame that slidably engages a respective end of the central beam.

3. The bogie of claim 1, wherein each end of the central beam includes a box that is constrained to move axially along the central slot in two directions.

4. The bogie of claim 1, wherein each end of the central beam includes a pin that is constrained to move axially and pivotally relative to the central slot in two directions.

5. The bogie of claim 1, wherein the actuator is a pneumatic actuator.

6. The bogie of claim 1, wherein the central beam further includes a socket adapted to provide a bolster connection between the central beam and a rail vehicle.

7. A rail vehicle, comprising:

a platform;

two bogies pivotally connected, one each, at either of two ends of the platform;

wherein each bogie includes:

two side frames, each side frame including two axle openings, each axle opening disposed on a corresponding end of the respective side frame, each side frame further forming a central slot disposed between the two axle openings;

two wheelsets, each wheelset including an axle passing through two opposing axle openings between the two side frames;

a central beam having two ends, each end being slidably disposed within a corresponding central slot such that the central beam is disposed generally parallel to the axles of the two wheelsets and is slidable towards or away either of the two wheelsets, wherein the central beam further includes a socket adapted to provide a bolster connection between the central beam and the rail vehicle.

8. The rail vehicle of claim 7, wherein each central slot includes a frame that slidably engages a respective end of the central beam.

9. The rail vehicle of claim 7, wherein each end of the central beam includes a box that is constrained to move axially along the central slot in two directions.

10. The rail vehicle of claim 7, wherein each end of the central beam includes a pin that is constrained to move axially and pivotally relative to the central slot in two directions.

11. The rail vehicle of claim 7, further comprising an actuator connected between at least one of the two side frames and the central beam, the actuator operating to move the central beam relative to the two wheelsets.

12. The rail vehicle of claim 11, wherein the actuator is a pneumatic actuator.

13. A method for operating a rail vehicle, comprising:

determining a loading condition of a bogie of the rail vehicle in terms of a load applied into a socket of the bogie and reaction forces present at each of at least two wheelsets of the bogie;

determining a reaction force at each of the at least two wheelsets;

selectively adjusting a geometrical relation between the socket of the bogie and each of the at least two wheelsets of the bogie;

wherein the bogie includes;

two side frames, each side frame including two axle openings, each axle opening disposed on a corresponding end of the respective side frame, each side frame further forming a central slot disposed between the two axle openings;

two wheelsets, each wheelset including an axle passing through two opposing axle openings between the two side frames; and a central beam having two ends, each end being slidably disposed within a corresponding central slot such that the central beam is disposed generally parallel to the axles of the two wheelsets and is slidable towards or away either of the two wheelsets; and wherein determining a reaction force includes monitoring a speed of each of the wheelsets and comparing the respective speeds of at least two wheelsets to determine whether a set of wheels attached to each of the two wheelsets is slipping relative to a railway.

14. The method of claim 13, wherein each central slot includes a frame that slidably engages a respective end of the central beam.

15. The method of claim 13, wherein each end of the central beam includes a box that is constrained to move axially along the central slot in two directions.

16. The method of claim 13, further comprising activating an actuator connected between at least one of the two side frames and the central beam to move the central beam relative to the two wheelsets such that a reaction force on a wheelset having a set of wheels that are determined to be slipping is increased.

* * * * *